US006851623B1

(12) United States Patent
Watterworth

(10) Patent No.: US 6,851,623 B1
(45) Date of Patent: Feb. 8, 2005

(54) WATER SPRAY NOZZLE RING FOR AND THE APPLICATION OF SPRAY-ON FIREPROOFING

(75) Inventor: Kenneth R. Watterworth, Southbury, CT (US)

(73) Assignee: Ken Watterworth, Inc., Waterbury, CT (US)

( * ) Notice: Subject to any disclaimer, the term of this patent is extended or adjusted under 35 U.S.C. 154(b) by 149 days.

(21) Appl. No.: 10/247,145

(22) Filed: Sep. 19, 2002

(51) Int. Cl.[7] ..... B05B 1/26

(52) U.S. Cl. ..... 239/10; 239/398; 239/550; 239/556; 239/558; 239/561; 239/567; 239/548

(58) Field of Search ..... 239/398, 548, 239/550, 556, 558, 559, 560, 561, 567, 10

(56) References Cited

U.S. PATENT DOCUMENTS 1,978,125 A * 10/1934 Bennett ..... 427/196
2,433,463 A * 12/1947 Lampe ..... 239/422
3,255,973 A * 6/1966 Crowley ..... 239/422
3,844,485 A * 10/1974 Waggoner ..... 239/420
4,542,040 A * 9/1985 Nowak ..... 427/196
6,113,990 A * 9/2000 Killingsworth ..... 427/426

* cited by examiner

*Primary Examiner*—Robin O. Evans
(74) *Attorney, Agent, or Firm*—Carmody & Torrance LLP

(57) ABSTRACT

A nozzle ring assembly comprising a nozzle ring having a plurality of recesses for accepting a plurality of nozzle tips; a plurality of a first type of nozzle tips from which water emanates, the first type of nozzle tips being arranged about the face of the nozzle ring so that water emanating therefrom contacts the fireproofing material at a first distance from the nozzle ring, wherein the first type of nozzle tips provides a water spray for at least essentially uniformly mixing water and the fireproofing material; and a plurality of a second type of nozzle tips from which water is emanates, the second type of nozzle tips being arranged about the face of the nozzle ring so that water emanating therefrom contacts the fireproofing material at a second distance greater than the first distance, wherein the second type of nozzle tips provides a water spray that provides additional impact pressure of the fireproofing material against the surface. A system for providing spray-on fire proofing and a method of applying fire proofing material to a surface is also provided.

13 Claims, 19 Drawing Sheets

WATER SPRAY NOZZLE - SIDE VIEW
SCALE : FULL

WATER SPRAY NOZZLE - PLAN VIEW
SCALE : FULL

SECTION THRU FAN NOZZELS
SCALE : HALF

FAN SPRAY PATTERN @ ELEV 4"
SCALE : HALF

FAN SPRAY PATTERN @ ELEV 8"
SCALE : HALF

FAN SPRAY PATTERN @ ELEV 12"
SCALE : HALF

SECTION THRU CONE NOZZELS
SCALE : HALF

CONE SPRAY PATTERN @ ELEV 1 1/2"
SCALE : HALF

CONE SPRAY PATTERN @ ELEV 3"
SCALE : HALF

CONE SPRAY PATTERN @ ELEV 12"
SCALE : HALF

CONE & FAN SPRAY PATTERN - SIDE VIEW
SCALE : HALF

CONE & FAN SPRAY PATTERN @ ELEV 4"
SCALE : HALF

CONE & FAN SPRAY PATTERN @ ELEV 8"
SCALE : HALF

CONE & FAN SPRAY PATTERN @ ELEV 12"
SCALE : HALF

PRIOR ART SPRAY PATTERN - SIDE VIEW
SCALE : HALF

PRIOR ART SPRAY PATTERN @ ELEV 4"
SCALE : HALF

PRIOR ART SPRAY PATTERN @ ELEV 8"
SCALE : HALF

PRIOR ART SPRAY PATTERN @ ELEV 12"
SCALE : HALF

WATER SPRAY NOZZLE RING FOR AND THE APPLICATION OF SPRAY-ON FIREPROOFING

BACKGROUND OF THE INVENTION

The present invention relates generally to water spray nozzle rings, and more particularly, to a water spray nozzle ring assembly used in the application of spray-on fireproofing material. A method of applying the spray-on fireproofing material and a system used in connection therewith, is also provided.

Spray-on fireproofing of structural steel members is accomplished by the use of either wet or dry fireproofing material. In the application to which the present invention pertains, the dry fireproofing material is mixed with water ejected by the nozzle ring, with the fireproofing material ejected from a hose separate from the hose that carries the water. Together, the wetted material is provided onto a steel member or other member to be fireproofed. The dry material, under pressure from a blower unit, passes through the water spray nozzle ring, where wetting of the material takes place.

A conventional water spray nozzle ring typically employs six (6) typically identical nozzle tips to create a mixing spray for the dry material. However, it has been found that the spray of water emitted by these nozzles do not uniformly combine water with the dry material. In fact, areas created in the spray field contained voids of water. Upon examination of the sprayed-on material, small pockets of material approximately ½ in diameter are observed to be dry. This results in inconsistent adhesion and cohesion bond strengths. In addition, areas of reduced or non-existent water flow are created at the nozzle ring, resulting in a less than desirably mixed, dry pockets of fireproofing material.

Accordingly, it is desirable to provide a water spray nozzle ring assembly that overcomes the foregoing deficiencies and provides the objects and advantages set forth below. Specifically, the present invention does in fact overcome the foregoing deficiencies and provides the objects and advantages set forth below.

OBJECTS AND SUMMARY OF THE INVENTION

Specifically, it is an object of the present invention to provide an improved water spray nozzle ring assembly for the application of fireproofing materials.

It is another object of the present invention to provide an improved water spray nozzle ring assembly for the application of fireproofing materials that eliminates unsatisfactory mixing and dry pockets of spray-on material.

Another object of the invention is to provide an improved water spray nozzle ring assembly for the application of fireproofing materials that create a field of intersecting spray patterns to more efficiently wet and mix the fireproofing material prior to its adhering to a surface.

Still another object of the present invention is to provide an improved water spray nozzle ring assembly for the application of fireproofing materials that provides a more efficient injection of water into the dry fireproofing material.

Yet another object of the present invention is to improve the application of spray-on fireproofing material.

Still a further object of the present invention is to provide an improved water spray nozzle ring assembly for the application of fireproofing materials that more efficiently saturates the material so that adhesion and cohesion bond strength is enhanced.

A further object is to provide a water spray nozzle ring assembly that more consistently directs wetted fireproofing material onto a member to be fireproofed.

Still other objects and advantages of the invention will in part be obvious and will in part be apparent from the specification.

The invention accordingly comprises the features of construction, combination of elements and arrangement of parts and sequence of steps which will be exemplified in the construction and methodology hereinafter set forth, and the scope of the invention will be indicated in the claims.

The objects and advantages set forth herein are carried out by a water spray nozzle ring assembly constructed in accordance with the present invention. In a preferred embodiment, the assembly comprises a nozzle ring comprising a plurality of recesses for accepting a plurality of nozzle tips; a plurality of a first type of nozzle tips from which water emanates, the first type of nozzle tips being arranged about the face of the nozzle ring so that water emanating therefrom contacts the fireproofing material at a first distance from the nozzle ring, wherein the first type of nozzle tips provides a water spray for at least essentially uniformly mixing water and the fireproofing material; and a plurality of a second type of nozzle tips from which water is emanates, the second type of nozzle tips being arranged about the face of the nozzle ring so that water emanating therefrom contacts the fireproofing material at a second distance greater than the first distance, wherein the second type of nozzle tips provides a water spray that provides additional impact pressure of the fireproofing material against the surface.

Particular features of the present invention include angling the face of the nozzle ring at approximately 3 degrees, providing the nozzle ring to be at least essentially circular, proving that the first type of nozzle tips are 50-degree solid cone nozzle tips arranged about the face of nozzle ring and the second type of nozzle tips are 15-degree flat nozzles tips arranged about the face of the nozzle ring, such that the first and second type of nozzle tips alternate in their positioning about the face of nozzle ring. In a preferred embodiment, there are twelve total nozzle tips being made up of six nozzle tips of the first type and six nozzle tips of the second type. An additional feature provided by the preferred construction is the creation of an overspray area on either side of the 50 degree solid cone areas, which ensures the pre-wetting and post-wetting of the fireproofing material.

A system for providing spray-on fire proofing, is also provided and preferably comprises the water spray nozzle ring assembly disclosed above; a first hose for providing water to the recesses in the water spray nozzle ring; a second hose coupled to the nozzle ring for providing fireproofing material to the opening; and a pump and blower assembly, coupled to the second hose, for ejecting the fireproofing material through the second hose and out the opening in the nozzle ring.

A method of applying fire proofing material to a surface is also provided and comprises the steps of providing dry mix fireproofing material to a pump and blower assembly; ejecting the dry mix fireproofing material though a hose and out an opening in a water spray nozzle ring assembly, and wetting at least essentially all of the dry mix fireproofing material prior to its contacting the surface. In a preferred method, the following steps are included, namely, mixing water and the fireproofing material at a first distance from the nozzle ring with water emanating from the first type of nozzle tips; mixing water and the fireproofing material at a second distance from the nozzle ring with water emanating from the second type of nozzle tips, wherein the second distance is greater than the first distance; wherein the water emanating from the first type of nozzle tips provides a water spray for at least essentially uniformly mixing water and the fireproofing material and the water emanating from the second type of nozzle tips provides a water spray that provides additional impact pressure of the fireproofing material against a surface.

BRIEF DESCRIPTION OF THE DRAWINGS

Like parts will be identified by like reference numbers in the figures, but not every part will be provided with a reference number, and this should not be construed in a limiting manner.

DETAILED DESCRIPTION OF THE PREFERRED EMBODIMENTS

Generally speaking, the nozzle tips are mounted on a preferably circular aluminum water nozzle ring. The face of the water nozzle ring where the tips are located is angled at approximately 3 degrees, although this exact tilt is not critical, as slight variations are still within the scope of the invention. However, this angle positions the nozzle tips so that their field of spray intersect in the manner disclosed below. Located on the underside of the ring is a threaded water inlet, which allows pressurized water into the ring assembly. Preferably, twelve nozzle tips are used, and are located ¾ inch apart around the face of the water nozzle ring. Six of the tips emit 50 degree cones of solid water spray that intersect three inches from the center of the water nozzle ring opening. Again, the use of exactly 50 degree tips can be varied slightly while remaining within the scope of the invention. The spray from these tips combine to create a solid mass of water flow from about three inches out from the water nozzle ring face to the substrate of the structural steel member or other member being fireproofed. The remaining six nozzle tips emit a 15 degree fan shape of water. Again, 15 degrees being the preferred angle but again, slight variations are within the purview of one skilled in the art. Preferably, these tips are arranged in an alternating placement with the cone-shaped emitting tips. The fan-shaped patterns of water intersect approximately twelve inches from the face of the water nozzle ring, at a much higher force, which helps to propel the material onto the surface being fireproofed.

Figure 1:
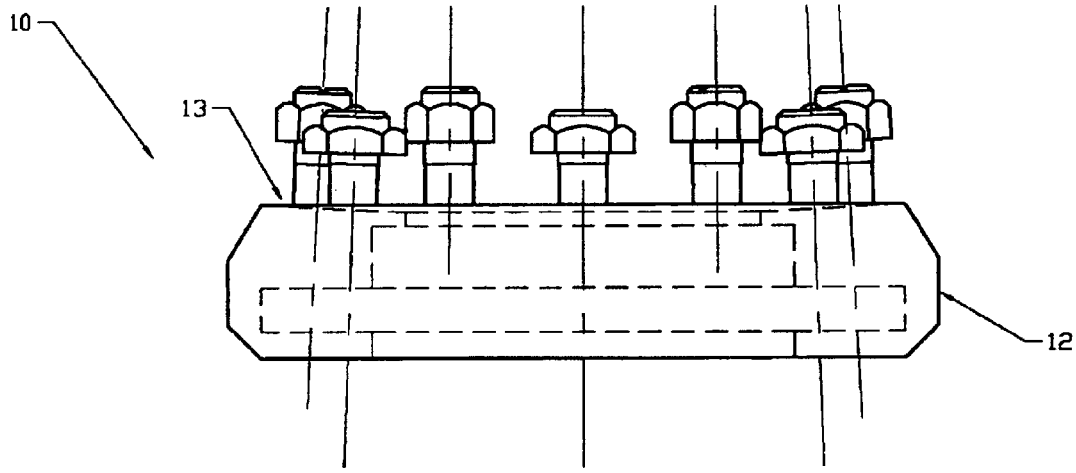
FIG. 1 is a side view of a water spray nozzle ring assembly constructed in accordance with the present invention with certain nozzle tips not being shown for ease of understanding.
Figure 2:
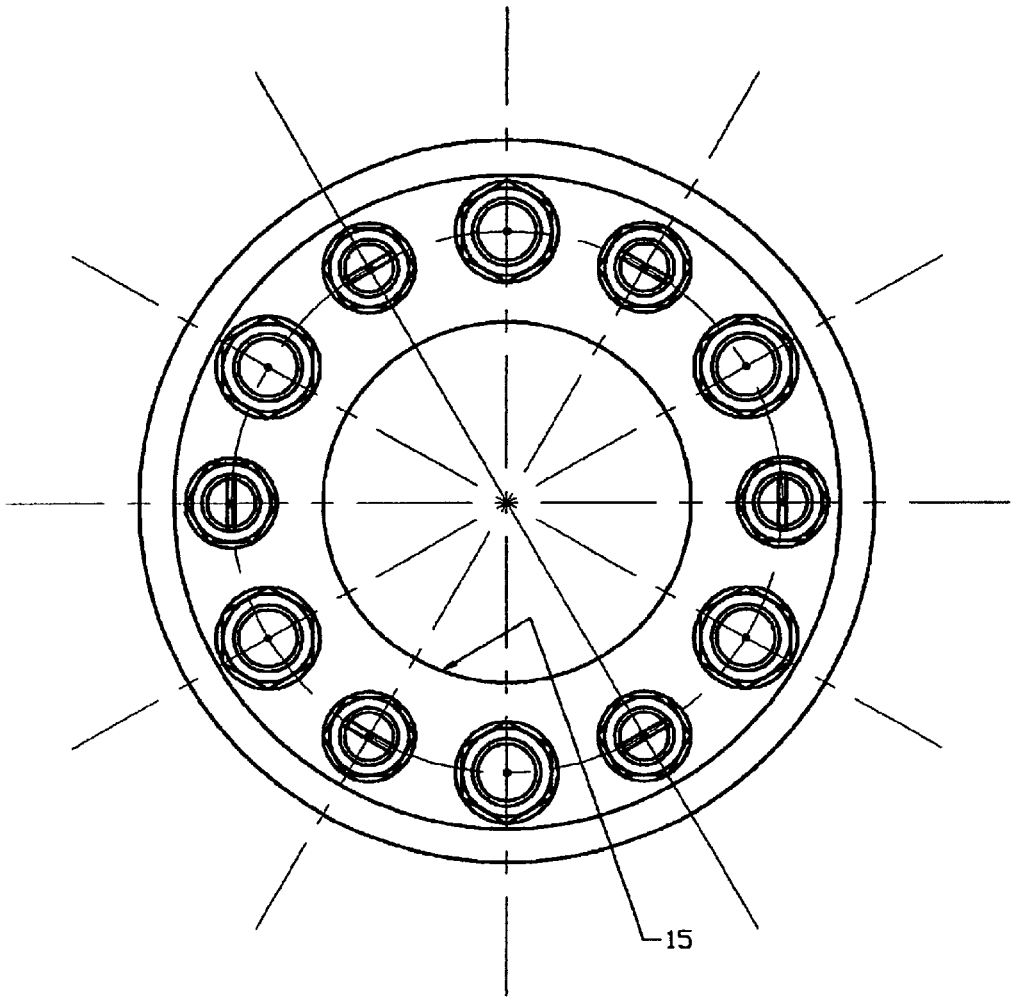
FIG. 2 is a top plan view of the water spray nozzle ring assembly of FIG. 1 with the preferred use of twelve nozzle tips being illustrated.
Figure 3:
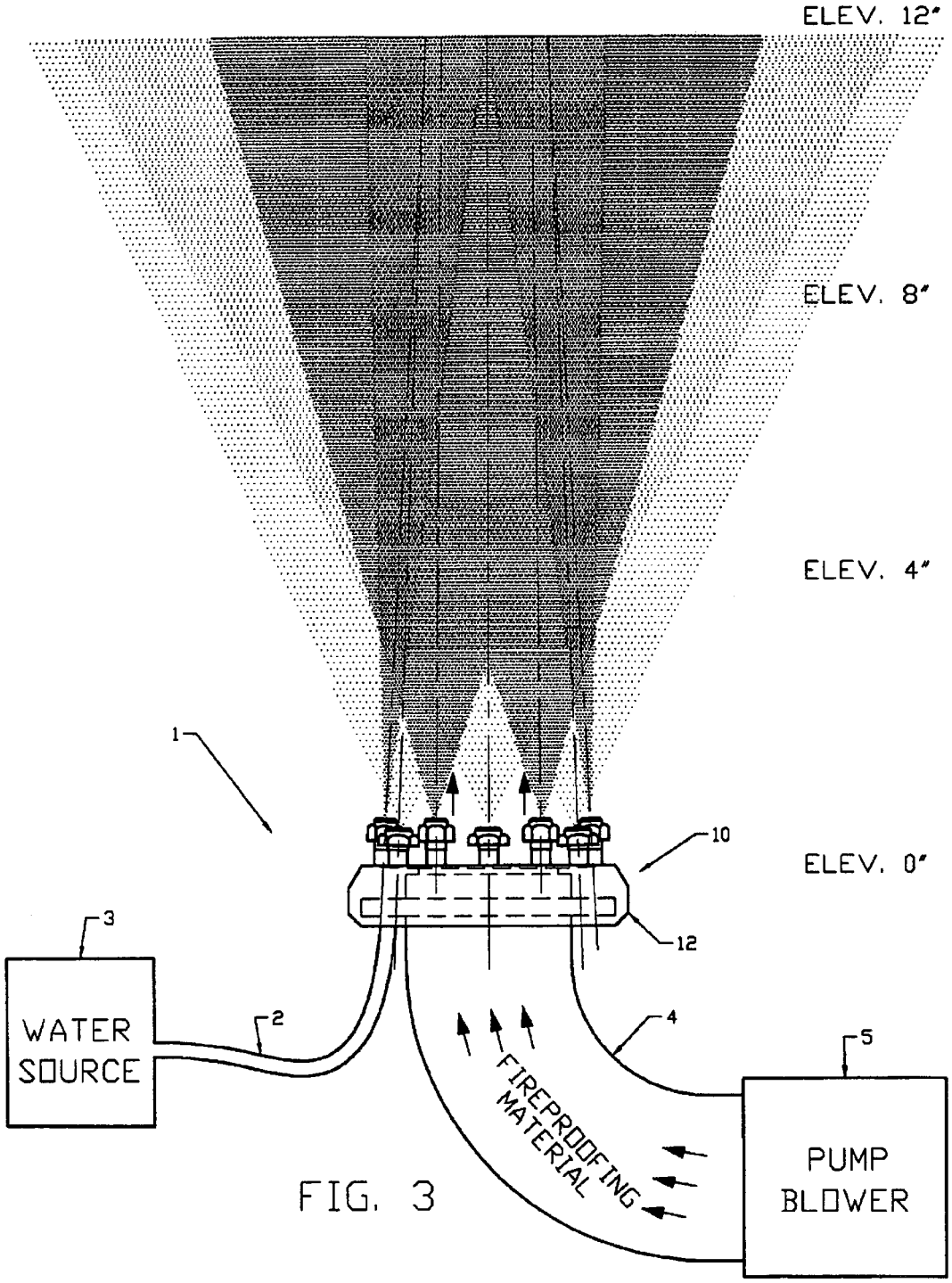
FIG. 3 is a system for applying fireproofing material using the water spray nozzle ring assembly of FIGS. 1 and 2.
Figure 4:
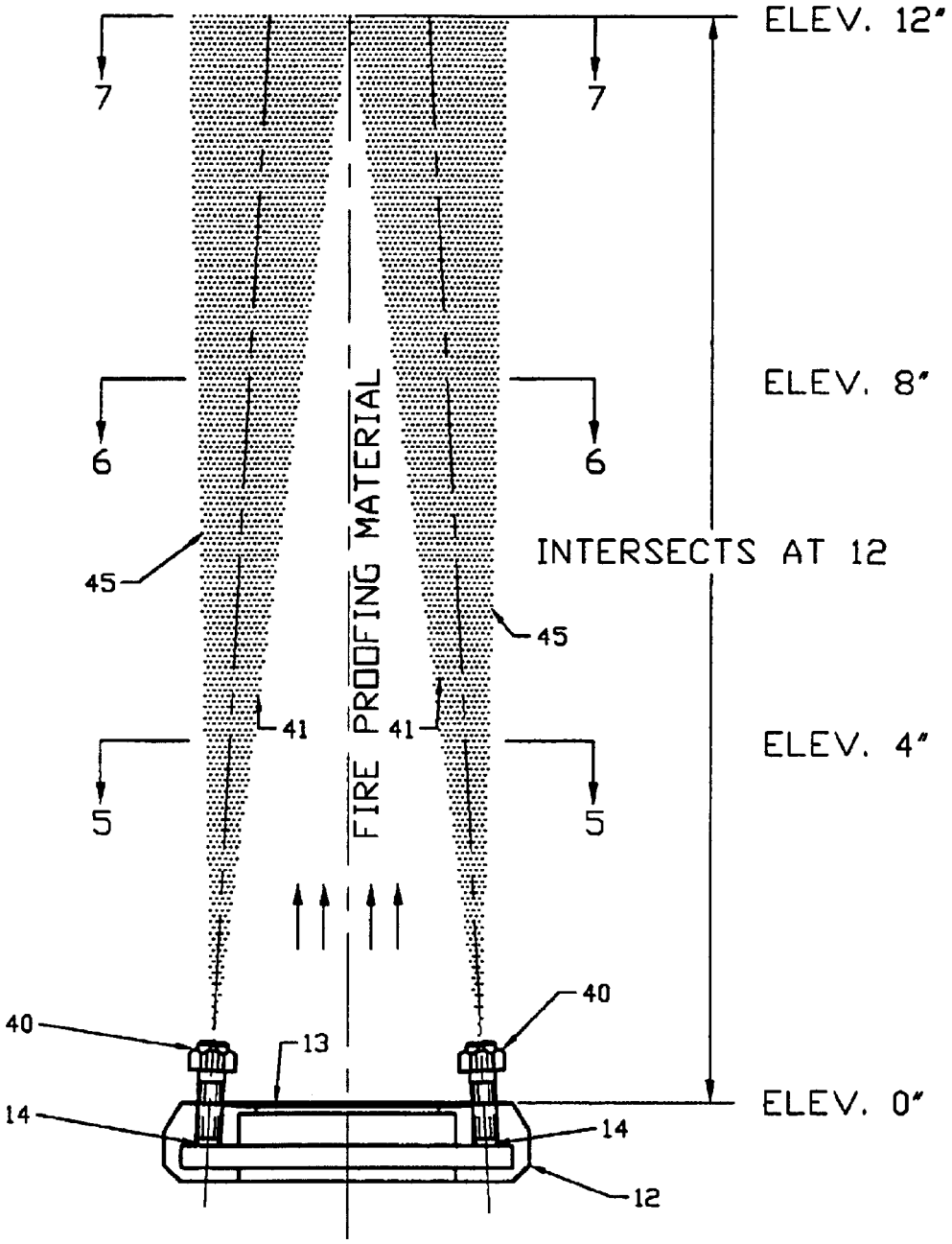
FIG. 4 is a side view in partial cross-section illustrating the spray pattern of two fan nozzle tips used in connection with the water spray nozzle ring assembly of FIG. 1.
Figure 8:
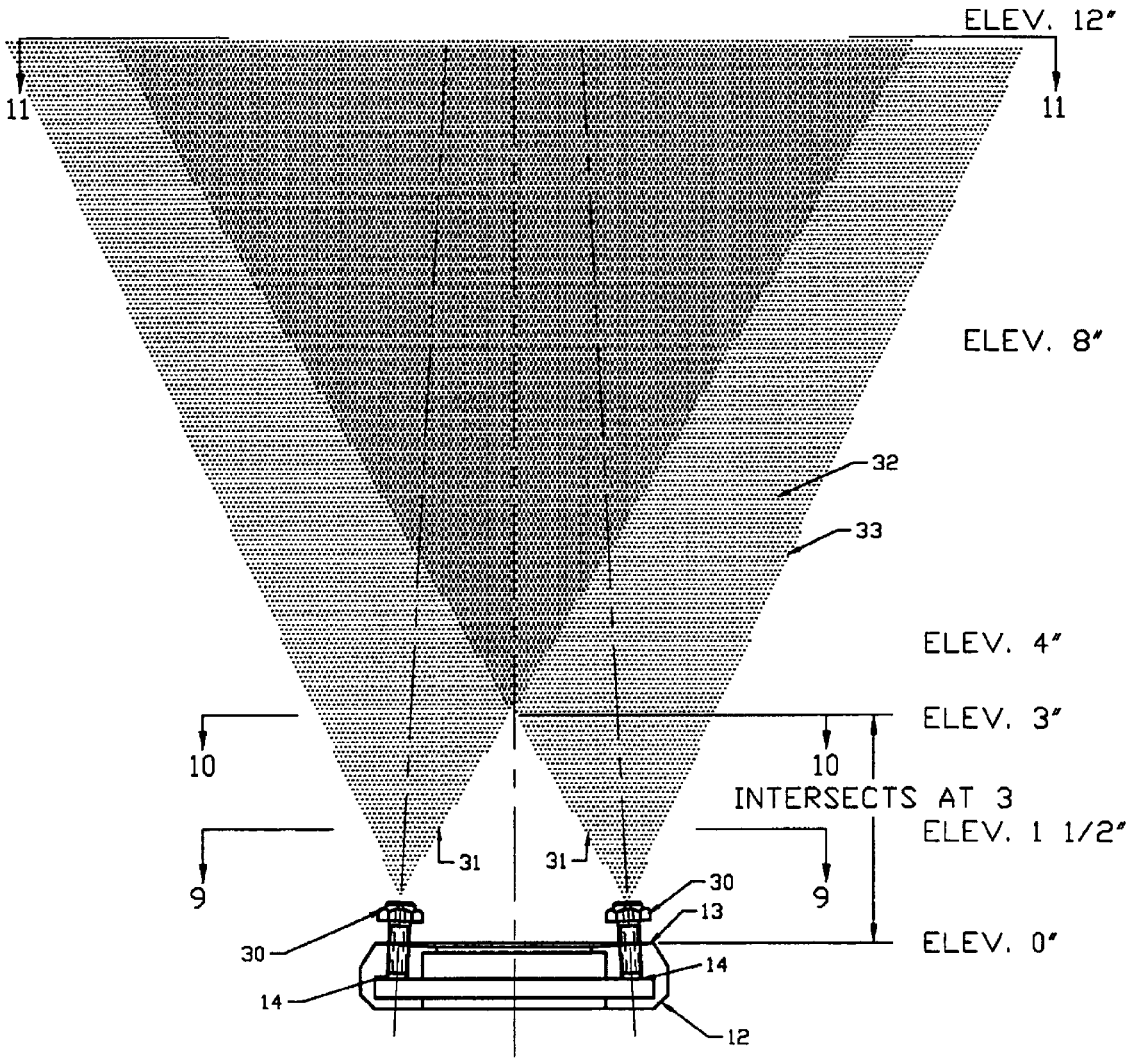
FIG. 8 is a side view in partial cross-section illustrating the spray pattern of two cone nozzle tips used in connection with the water spray nozzle ring assembly of FIG. 1.

Reference will now be made in particular to FIGS. 1–3 for a general understanding of the present invention. Specifically, FIGS. 1 and 2 illustrate a water spray nozzle ring assembly, generally indicated at 10, constructed in accordance with the present invention. Assembly 10 comprises a ring 12 preferably made of aluminum having an inner diameter of about two inches and an outer diameter of about 3¾ inches. Ring 12 also includes a plurality of threaded recesses 14 (FIGS. 4 & 8) into which a plurality of nozzle tips are positioned as further discussed below. FIG. 2 more particularly illustrates all 12 nozzle tips positioned along the surface of the ring 12 and disposed within the threaded recesses. As would be expected, each nozzle tip has a complementary threaded shaft. An opening 15, preferably 2 inches in diameter, is provided in the ring 12 through which the fireproofing material is discharged.

The angle of the water nozzle face 13 is preferably 3 degrees, and the nozzles are arranged around this face. A water nozzle face angled at 3 degree makes the first column of water meet at 3 inches as will be disclosed below, and the second column of water at 12 inches. As will also be disclosed in greater detail below, there are six alternating 15 degree flat fan nozzle tips 40, delivering 0.35 gallons of water per minute, and six 50 degree cone nozzle tips 30 delivering 0.57 gallons per minute of water.

FIG. 3 illustrates a system 1 for applying fireproofing material using the water spray nozzle ring assembly 10 that will be more particularly disclosed below. System 1 also comprises a first hose 2 for providing water from a water source 3 to the recesses in the water spray nozzle ring 12. That is, ring 12 includes a cavity (not shown) through which water can be distributed within the ring for ejection out of the nozzle tips. The end of the hose 2 that is coupled to ring 12 can be threadably coupled thereto in a known manner. A second hose 4 is also coupled at one end to the nozzle ring 12, such as by pressure fit. The other end of hose 4 is connected to a pump and blower assembly 5. Assembly 5 ejects the fireproofing material through second hose 4 and out the opening 14 in the nozzle ring 12. A suitable assembly 5 for use in system 1 is manufactured by Unisol.

Figure 5:
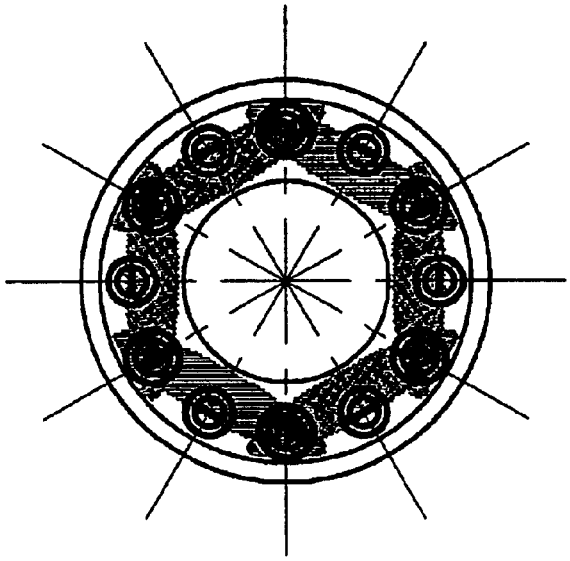
FIG. 5 is a top plan view of the preferred construction of the water spray nozzle ring assembly of the present invention, taken about lines 5—5 of FIG. 4 and illustrating the spray pattern achieved with six (6) fan nozzle tips arranged in alternating positions at a distance approximately 4 inches from the top surface of the nozzle ring.
Figure 6:
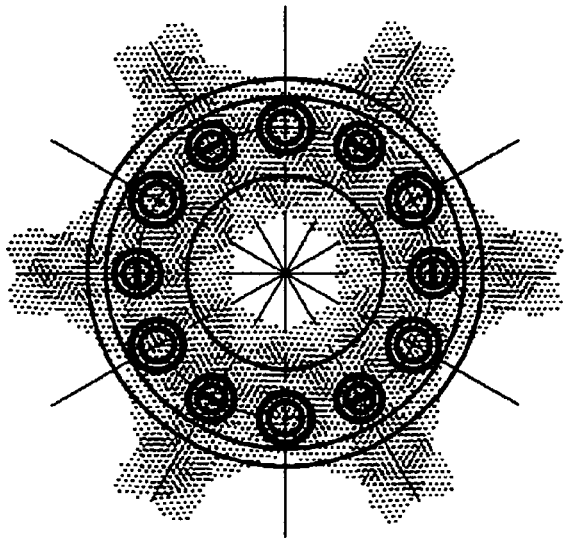
FIG. 6 is a top plan view of the preferred construction of the water spray nozzle ring assembly of the present invention, taken about lines 6—6 of FIG. 4 and illustrating the spray pattern achieved with the six (6) fan nozzle tips arranged in alternating positions at a distance approximately 8 inches from the top surface of the nozzle ring.
Figure 7:
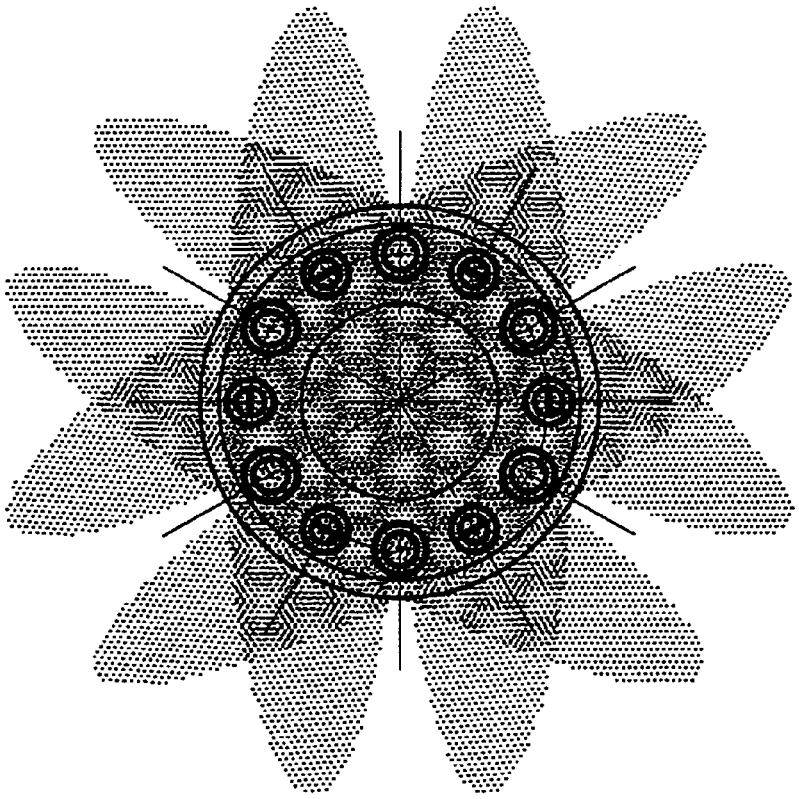
FIG. 7 is a top plan view of the preferred construction of the water spray nozzle ring assembly of the present invention, taken about lines 7—7 of FIG. 4 and illustrating the spray pattern achieved with the six (6) fan nozzle tips arranged in alternating positions at a distance approximately 12 inches from the top surface of the nozzle ring.

Reference is now made to FIGS. 4–7 wherein the spray pattern 45 emitted by the plurality of flat nozzle tips 40 are illustrated. The inner edges 41 of this spray pattern converges at a point approximately twelve (12) inches from the center of the water spray nozzle face 13. FIGS. 5–7 illustrate the intersecting spray patterns from the six cone nozzle tips 40 at varying distances from face 13. This stream of water provides both impact pressure and a more direct wetting contact with the track of the dry materials propelled from the hose 4. The water flow is approximately 2.10 gallons per minute.

Figure 9:
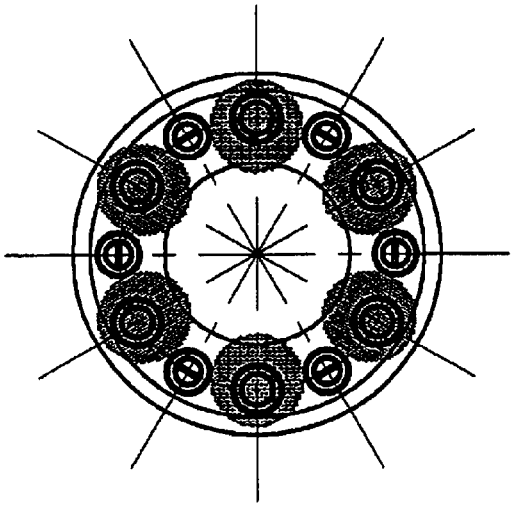
FIG. 9 is a top plan view of the preferred construction of the water spray nozzle ring assembly of the present invention, taken about lines 9—9 of FIG. 8 and illustrating the spray pattern achieved with six (6) cone nozzle tips arranged in alternating positions at a distance approximately 1.5 inches from the top surface of the nozzle ring.
Figure 10:
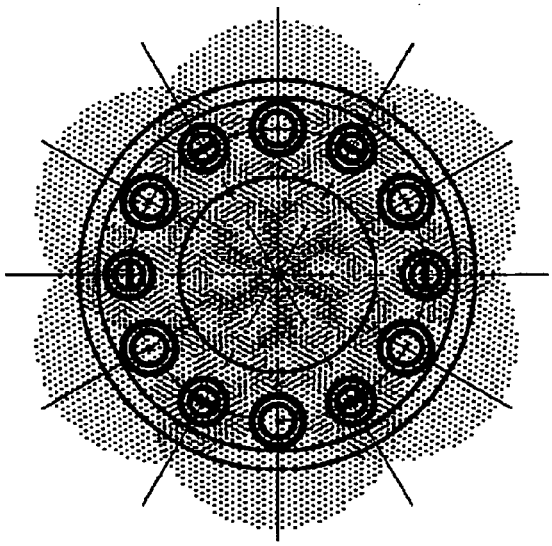
FIG. 10 is a top plan view of the preferred construction of the water spray nozzle ring assembly of the present invention, taken about lines 10—10 of FIG. 8 and illustrating the spray pattern achieved with the six (6) cone nozzle tips arranged in alternating positions at a distance approximately 3 inches from the top surface of the nozzle ring.
Figure 11:
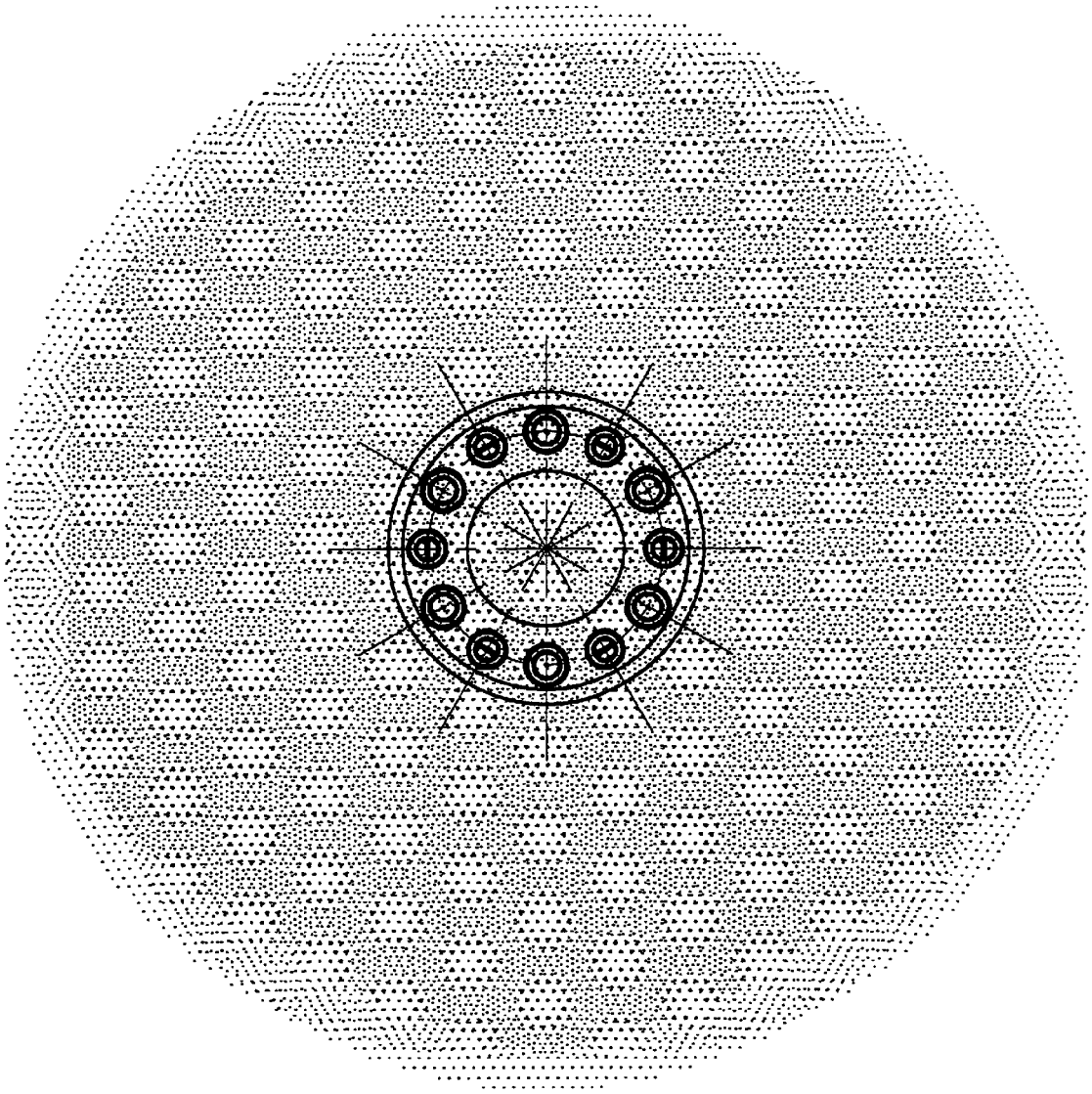
FIG. 11 is a top plan view of the preferred construction of the water spray nozzle ring assembly of the present invention, taken about lines 11—11 of FIG. 8 and illustrating the spray pattern achieved with the six (6) cone nozzle tips arranged in alternating positions at a distance approximately 12 inches from the top surface of the nozzle ring.
Figure 12:
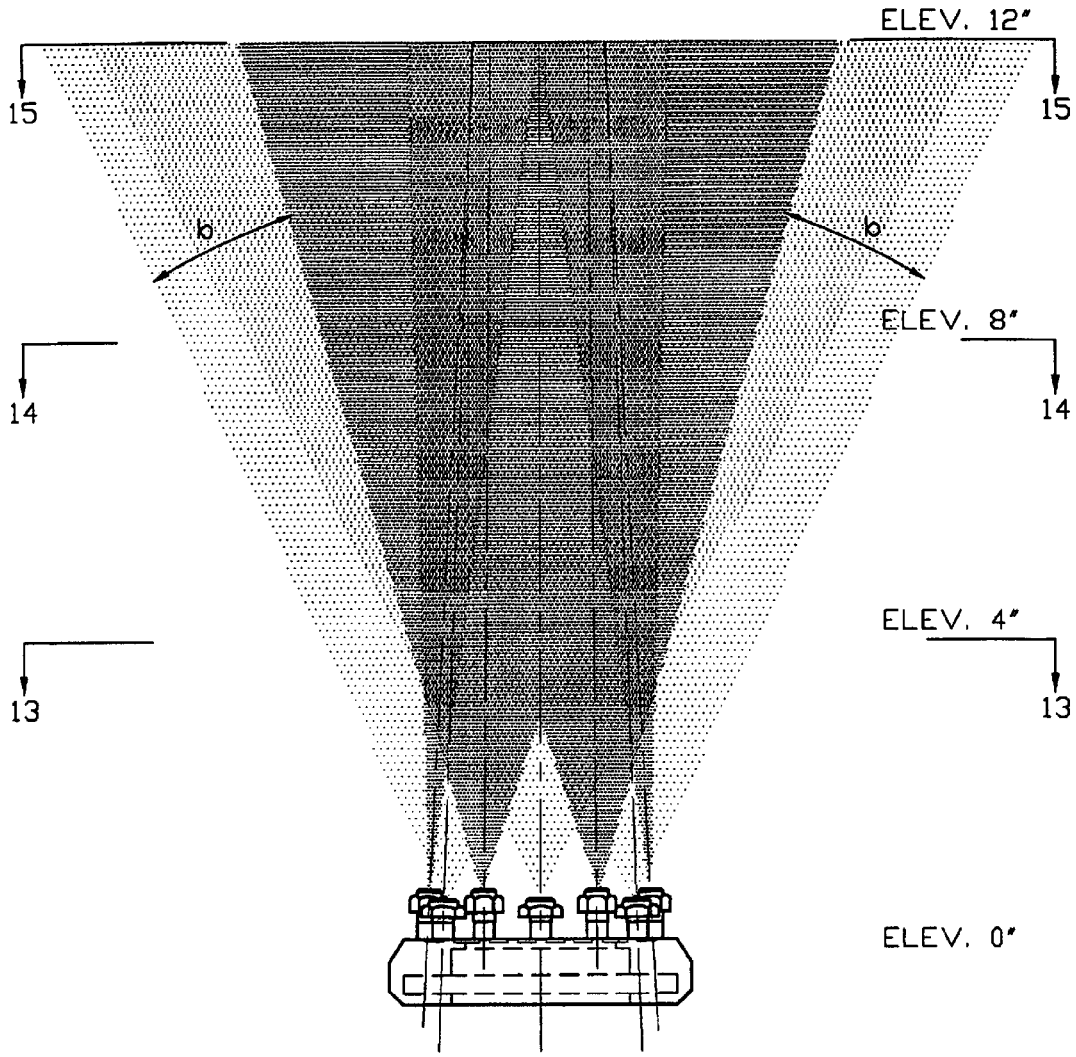
FIG. 12 is a side view of the ring assembly illustrating the combined effect of the cone and fan shaped nozzle tips, with only seven nozzle tips being shown for ease of understanding, with the distinct blue (cone shaped spray) and gray (fan shaped spray) being used to illustrate the differing water sprays.
Figure 13:
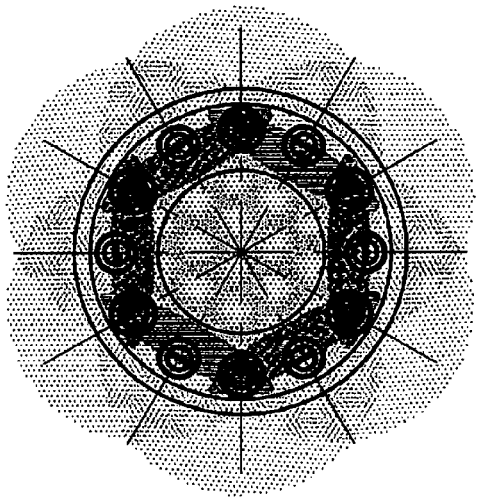
FIG. 13 is a top plan view of the preferred construction of the water spray nozzle ring assembly of the present invention, taken about lines 13—13 of FIG. 12 and illustrating the spray pattern achieved with the six (6) cone nozzle tips and the six (6) fan nozzle tips arranged in alternating positions at a distance approximately 4 inches from the top surface of the nozzle ring.
Figure 14:
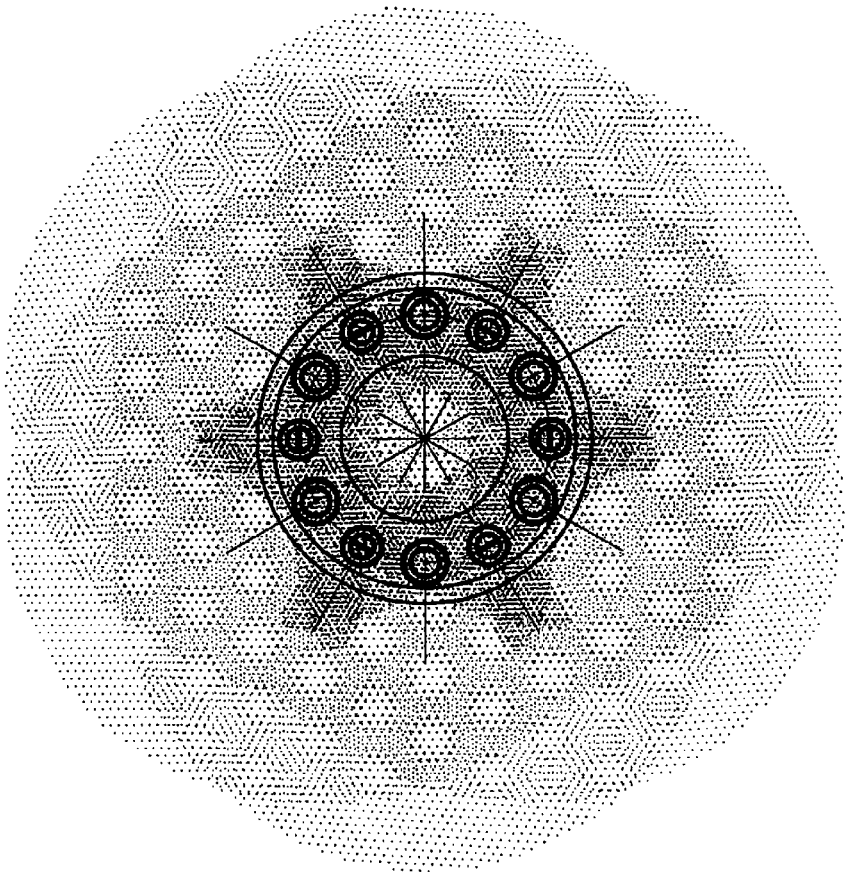
FIG. 14 is a top plan view of the preferred construction of the water spray nozzle ring assembly of the present invention, taken about lines 14—14 of FIG. 12 and illustrating the spray pattern achieved with the six (6) cone nozzle tips and the six (6) fan nozzle tips arranged in alternating positions at a distance approximately 8 inches from the top surface of the nozzle ring.
Figure 15:
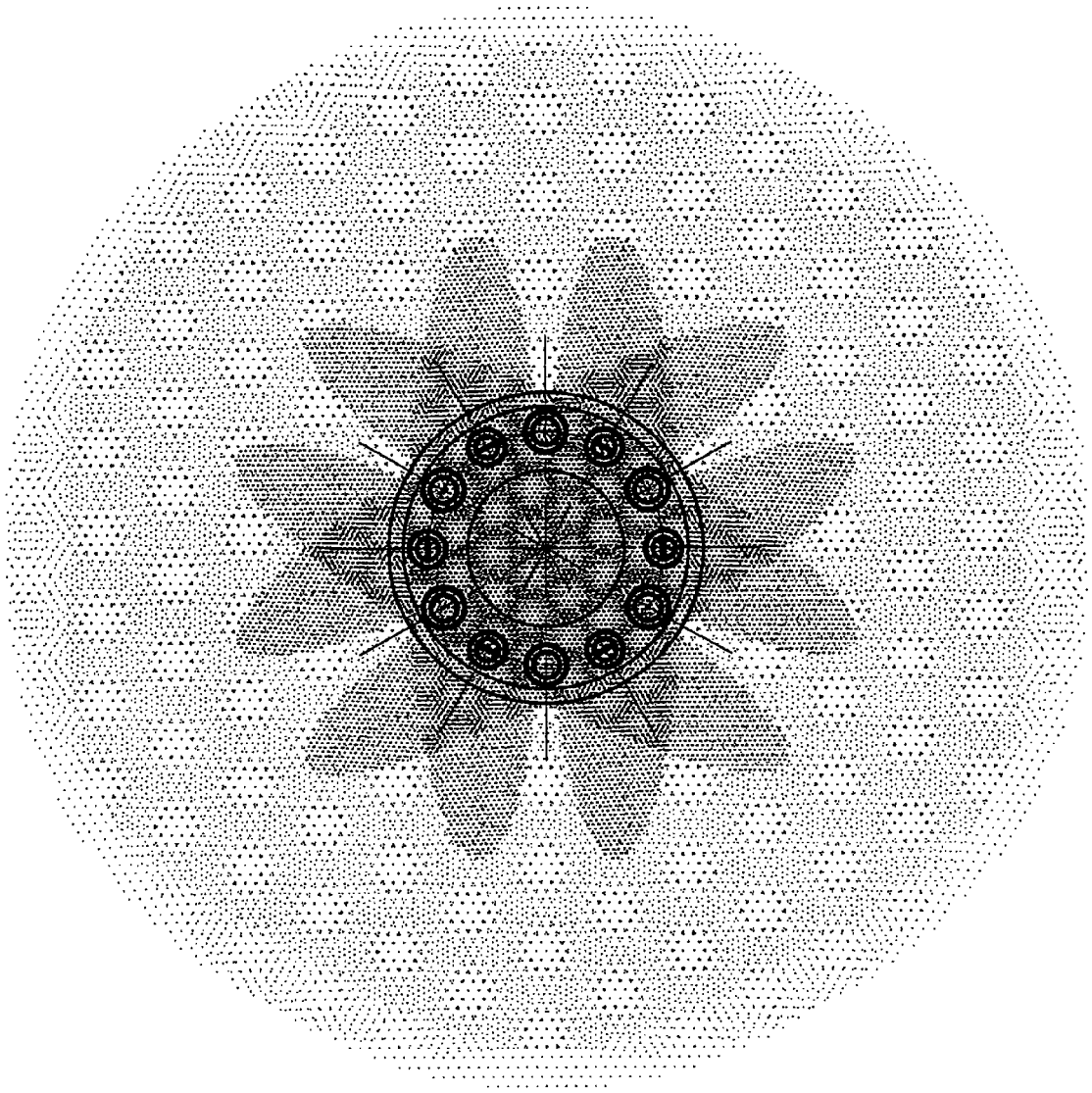
FIG. 15 is a top plan view of the preferred construction of the water spray nozzle ring assembly of the present invention, taken about lines 15—15 of FIG. 12 and illustrating the spray pattern achieved with the six (6) cone nozzle tips and the six (6) fan nozzle tips arranged in alternating positions at a distance approximately 12 inches from the top surface of the nozzle ring.
Figure 16:
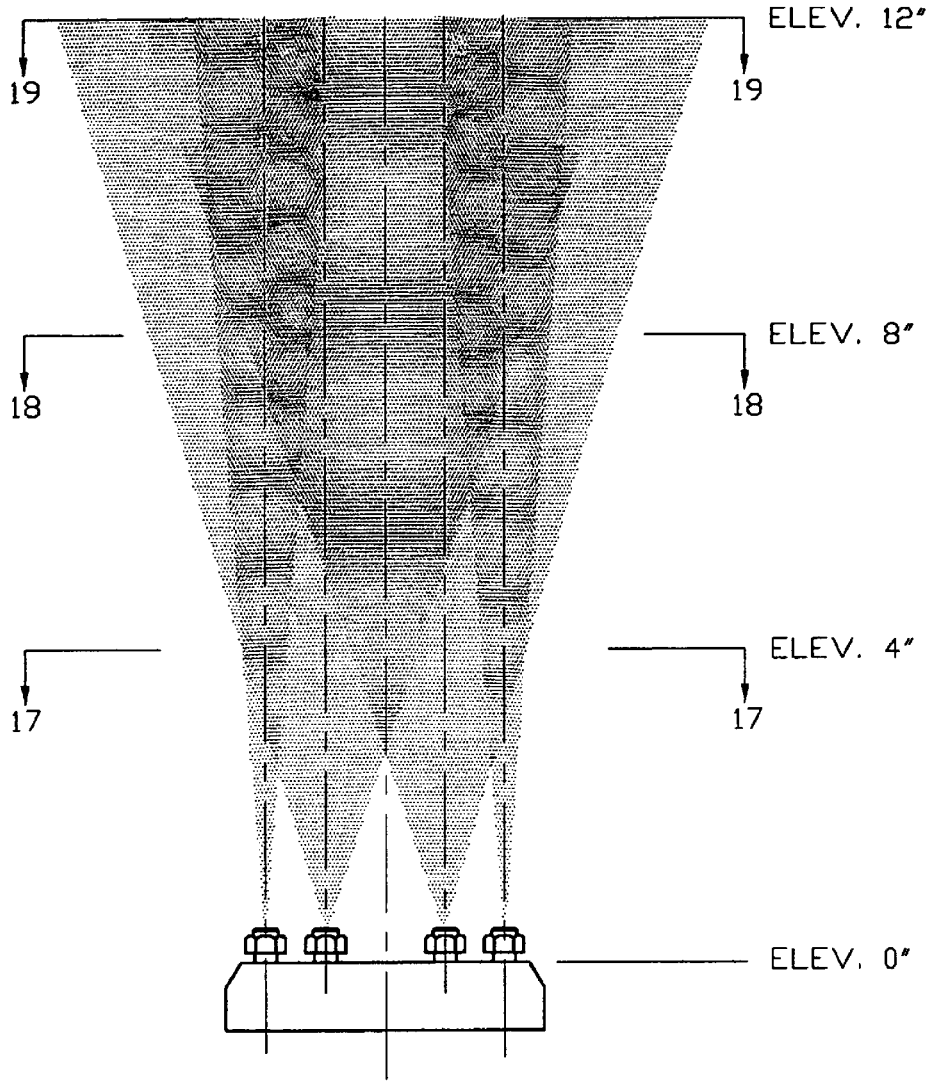
FIG. 16 is a side view of a ring assembly of the prior art, illustrating the spray effect of identical tips, with only four of six nozzle tips being shown for ease of understanding.
Figure 17:
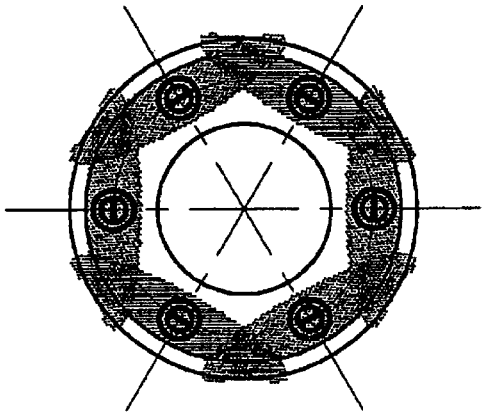
FIG. 17 is a top plan view of the prior art, taken about lines 17—17 of FIG. 16 and illustrating the spray pattern achieved with the six nozzle tips at a distance approximately 4 inches from the top surface of the nozzle ring.
Figure 18:
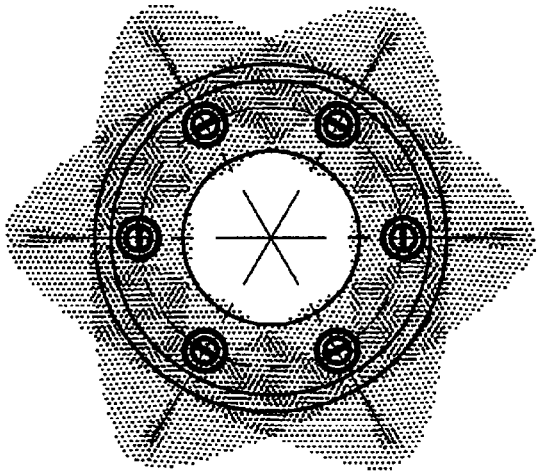
FIG. 18 is a top plan view of the prior art, taken about lines 18—18 of FIG. 16 and illustrating the spray pattern achieved with the six nozzle tips at a distance approximately 8 inches from the top surface of the nozzle ring.
Figure 19:
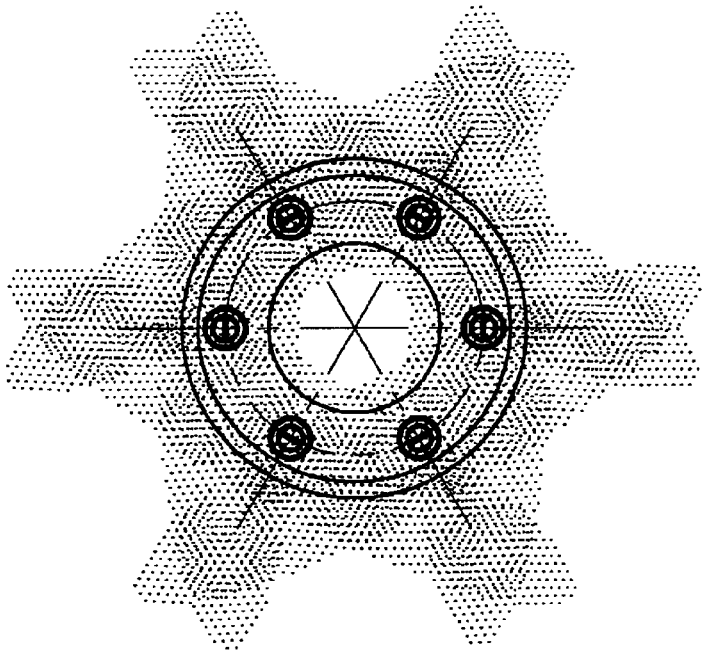
FIG. 19 is a top plan view of the prior art, taken about lines 19—19 of FIG. 16 and illustrating the spray pattern achieved with the six nozzle tips at a distance approximately 12 inches from the top surface of the nozzle ring.

Reference is now particularly made to FIG. 8-11 which illustrate ring 12 with a plurality of cone nozzle tips 30 and the conical spray pattern it creates, the spray pattern 32 being illustrated by the gray dots. As illustrated, an inside edge 31 of spray pattern 32 intersects the center of the two-inch, dry product opening 15 at a distance of about three inches from face 13 of the water nozzle ring 12. An outside edge 33 of spray pattern 32 depicts the overspray portion of the water flow, angled 50 degrees outside the perpendicular perimeter of the water nozzle ring 12. FIGS. 9–11 more particularly illustrate the plurality of cone nozzle tips 30 (preferably numbering six (6)) arranged in alternating positioning around the ring 20) and the combined effect of the spray pattern produced thereby. As illustrated, the conical spray radiates out and provides the spray pattern taken at the respective distances of 1.5 inches, 3 inches and 12 inches. Specifically, the six 50 degree solid cone tips 30 are emitting a combined pattern of water spray that converges at about three inches from the water nozzle face 15. This creates a solid mass of water from a point denoted "a" to the substrate or other surface to be fireproofed, located in the preferred application to be about 18 inches away from the face 13. The volume of water produced by the solid cone tips is approximately 3.42 gallons per minute. This provides a uniform, consistent wetting area. As can be seen in the figures, there are no hollow areas of water flow in this wide area of concentrated dispersal.

Reference is now made to FIGS. 12–15 which illustrate all twelve nozzle tips, arranged in alternating fashion of flat nozzle tips 40 and cone tips 30, working in unison, creating a clearly defined central concentration of water flow. An additional overspray section "b" produces a wide area of pre and post wetting contact. Together, the twelve nozzle tips 30, 40 provide a total of approximately 5.52 gallons of water per minute.

Now that the present invention has been disclosed, reference is briefly made to the prior art and specifically to FIGS. 16–19, to more particularly illustrate the advantages thereover. As illustrated by the prior art, the use of six identical nozzle tips in the manner illustrated does not overcome improper mixing and the existence of dry pockets of spray-on material since it can be seen that there are areas even upwards of 12 inches where wetting of the fireproofing material does not occur. Moreover, the prior art does not create a field of intersecting spray patterns to as efficiently wet and mix fireproofing material or thus provide for as efficient a saturation of the material as the present invention. The prior art is therefore also less satisfactory than the present invention in directing the wetted fireproofing material onto a member to be fireproofed. Also the prior art does not provide the pre-wetting and post-wetting of the fireproofing material as provided by the present invention due to the absence of an overspray area.

As can therefore be seen, the present invention provides for improved fireproofing of structural steel members, or other members to be fireproofed. The material is blown through a hose dry and is mixed with water at the water spray nozzle ring, located at the end of the hose. Utilizing the present invention, the fireproofing material is more efficiently saturated so that adhesion and cohesion bond strength is enhanced. In fact, data results show that the cohesion and adhesion bond strengths are between 300 and 500 pounds per square inch. Most preferably, and as exemplified above, this is accomplished by the combination of twelve spray nozzle tips, arranged about the face of a circular water nozzle ring, wherein six of the spray tips emit solid cones of water spray and the other six emit fan-shaped sprays of water. Together and as illustrated in the figures, these twelve spray tips together create precise intersecting fields of spray that thoroughly inject water into the dry fireproofing material, while the blower unit propels the material through the hose and onto the structural member.

Moreover, as seen above, the present invention provides for the mixture of the material with water more efficiently at the point of emission from the hose.

In summary, it can be seen that the angled placement of the cone-emitting nozzle tips on the water nozzle ring, combined with the 50 degree angles of water spray the tips emit, create fields of water that intersect more uniformly and closer to the water nozzle ring than occurred with conventional water spray nozzles. Furthermore, the creation of an uninterrupted mass of solid water flow from three inches from the water nozzle face out to the surface being fireproofed generated through the cone-shaped fields of spray. This distance of three inches allows the fireproofing material to expand out of the blower hose opening and combine thoroughly and quickly with the column of water emitted by the cone nozzles located on the spray nozzle ring. Still further, the advantage of the secondary column of water emitted by the 15-degree fan spray tips is that the fireproofing material becomes more concentrated in the spray areas of the fan-shaped nozzles. The water spray field now more closely follows the track of the material as emitted by the blower hose. Additionally, the creation of an overspray area on either side of the 50-degree solid cone areas ensures the pre-wetting and post-wetting of the fireproofing material. This pre and post-wetting of material does not occur in conventional water nozzle rings due to the absence of an overspray area.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein and all statements of the scope of the invention that as a matter of language might fall therebetween.

What is claimed is:

1. A water spray nozzle ring assembly for use in the application of spay-on fireproofing material upon a surface, the assembly comprising:

a nozzle ring comprising a plurality of recesses for accepting a plurality of nozzle tips;

a plurality of a first type of nozzle tips from which water emanates at a first pressure, the first type of nozzle tips being arranged about the face of the nozzle ring so that water emanating therefrom contacts the fireproofing material at a first distance from the nozzle ring, wherein the first type of nozzle tips provides a first water spray pattern for at least essentially uniformly mixing water and the fireproofing material; and a plurality of a second type of nozzle tips from which water is emanates at a pressure greater than the first pressure, the second type of nozzle tips being arranged about the face or the nozzle ring so that water emanating therefrom contacts the fireproofing material at a second distance greater than the first distance, wherein the second type of nozzle tips provides a second water spray pattern different from the first water spray pattern that provides additional impact pressure of the fireproofing material against the surface;

wherein the second water spray pattern at the higher water pressure causes an increase in concentration of fireproofing material at the second distance over the concentration or fireproofing material existing at the first distance.

2. The water spray nozzle ring assembly as claimed in claim 1, wherein the face of the nozzle ring is angled at approximately 3 degrees.

3. The water spray nozzle ring assembly as claimed in claim 1, wherein the nozzle ring is essentially circular.

4. The water spray nozzle ring assembly as claimed in claim 3, wherein the first type of nozzle tips are 50-degree solid cone nozzle tips arranged about the face of nozzle ring.

5. The water spray nozzle ring assembly as claimed in claim 4, wherein the 50-degree solid cone nozzle tips are arranged about 1.5 inches apart.

6. The water spray nozzle ring assembly as claimed in claim 4, wherein the first type of nozzle tips provide pre-wetting and post-wetting of the fireproofing material.

7. The water spray nozzle ring assembly as claimed in claim 3, wherein the second type of nozzle tips are 15-degree flat nozzles tips arranged about the face of the nozzle ring.

8. The water spray nozzle ring assembly as claimed in claim 7, wherein the 15-degree flit nozzles tips are arranged about 1.5 inches apart.

9. The water spray nozzle ring assembly as claimed in claim 3, wherein the first and second type of nozzle tips alternate in their positioning about the face of nozzle ring, and the fan-out of the second pattern at the second distance is less than the fan-out of the first pattern at the first distance.

10. The water spray nozzle ring assembly as claimed in claim 9, including six nozzle tips of the first type and six nozzle tips of the second type.

11. A system for providing spray-on fire proofing, the system comprising:

the water spray nozzle ring assembly as claimed in claim 1, wherein the nozzle ring includes an opening;

a first hose for providing water to the recesses in the water spray nozzle ring;

a second hose coupled to the nozzle ring for providing fireproofing material to the opening;

a pump and blower assembly, coupled to the second hose, for ejecting the fireproofing material through the second hose and out the opening in the nozzle ring.

12. A method of applying the fireproofing material to a surface with a spray nozzle ring assembly comprising a nozzle ring, the nozzle ring comprising a plurality of recesses for accepting a plurality of nozzle tips; a plurality of a first type of nozzle tips from which water emanates at a first pressure, the first type of nozzle tips being arranged about the face of the nozzle ring so that water emanating therefrom contacts the fireproofing material at a first distance from the nozzle ring, wherein the first type of nozzle tips provides a first water spray pattern for at least essentially uniformly mixing water and the fireproofing material; and a plurality of a second type of nozzle tips from which water emanates at a pressure greater than the first pressure, the second type of nozzle tips being arranged about the face of the nozzle ring so that water emanating therefrom contacts the fireproofing material at a second distance greater than the first distance, wherein the second type of nozzle tips provides a second water spray pattern different from the first water spray pattern, wherein the method comprises the steps of:

mixing water and the fireproofing material at the first distance from the nozzle ring with water emanating from the first type of nozzle tips;

mixing water and the fireproofing material at the second distance from the nozzle ring with water emanating from the second type of nozzle tips;

wherein the water emanating from the first type of nozzle tips provides a water spray for at least essentially uniformly mixing water and the fireproofing material and the water emanating from the second type of nozzle tips provides a water spray that provides additional impact pressure of the fireproofing material against a surface; and causing the increase in concentration of fireproofing material as the fireproofing material travels from the first distance towards the second distance due to combined action of the second water spray pattern at the higher water pressure.

13. The method as claimed in claim 12, wherein the first distance is approximately 3 inches from the face of nozzle ring and the second distance is approximately 12 inches from the face of the nozzle ring.

* * * * *